United States Patent [19]

Cross

[11] 4,161,109

[45] Jul. 17, 1979

[54] LATCHGUARDS

[75] Inventor: Eric Cross, Loughborough, England

[73] Assignee: William Cotton Limited, Leicestershire, England

[21] Appl. No.: 936,226

[22] Filed: Aug. 24, 1978

[30] Foreign Application Priority Data

Sep. 15, 1977 [GB] United Kingdom ..... 38581/77

[51] Int. Cl.[2] ..... D04B 11/04; D04B 15/08

[52] U.S. Cl. ..... 66/88; 66/111

[58] Field of Search ..... 66/88, 111

[56] References Cited

U.S. PATENT DOCUMENTS 3,129,572 4/1964 Werner ..... 66/111

3,377,822 4/1968 Start et al. ..... 66/88

3,397,555 8/1968 Blood et al. ..... 68/88

*Primary Examiner*—Ronald Feldbaum

*Attorney, Agent, or Firm*—Buell, Blenko & Ziesenheim

[57] ABSTRACT

A latchguard member is mounted on a rib needle bar assembly of a straight bar knitting machine of the Cotton's Patent type. The rib needles have latches which are pivotable between an open and closed attitude and the latchguard member is actuated to lie over the tips of the latches in the open attitude and to withdraw below the latches to permit them to close as the old loops are landed on the latches. In a preferred embodiment the actuating means for the latchguard member are arranged to superimpose a differential latchguard member and rib needle bar movement over their joint movement imparted by a needle bar actuating means.

4 Claims, 10 Drawing Figures

LATCHGUARDS

DESCRIPTION

1. Field of Invention

The invention relates to latchguards for rib needles of straight bar knitting machines. In straight bar knitting machines, the needles are mounted on a common needle bar and move to knit simultaneously.

The invention is particularly applicable to straight bar knitting machines equipped with bearded frame needles on a plain needle bar for knitting plain stitches and an associated rib needle bar with latch needles for knitting rib stitches. The bearded and latch needles cooperate to knit rib fabric used for rib borders of garments.

2. Background of Invention

The British Pat. No. 980,019 describes a hook bar for opening latches. Hooks of the hook bar also serve after opening the latches to guard them and ensure the latches remain open for taking new yarn. The hooks must engage the latch tips individually. The hook bar and latch needles are reciprocated by separate drive mechanisms in synchronism. Drive mechanisms, needles and hooks must be accurately adjusted as otherwise misalignment may occur.

The U.S. Pat. No. 3,397,555 uses latchguards on individual needles which guards have no latch opening function. The guards must be located accurately to ensure that new yarn is received properly in the latch needles whilst permitting the latch to operate normally. The cost of the needles which use such latchguards is high. The presser edge on the sinker bar is used in practice to open semi-closed latches, as the guards themselves do not physically engage the latches to hold them open.

It is an object of the invention to provide a latch guarding arrangement for rib needles which is reliable in operation and economic, and reduces unintentional closing of latches.

DESCRIPTION OF INVENTION

According to the invention there is provided a rib needle bar assembly for a straight bar knitting machine including a rib needle bar, latch needles mounted in the rib needle bar, a latchguard member extending transversely across the latch needle stems movable between a first position extending across the needle latches to prevent them closing but with sufficient clearance to allow old loops to clear the latches and a second position extending across the stems below the latches to permit closing of the latches by the old loops engaging the latches.

Using the invention there is no risk of latches springing toward closed position as the old loops are cleared over the latches. The latchguard member may be moved from the second to the first position when the old loops are being cleared and have opened the latches so that the latchguard member passes securely over all the open latches. The latchguard member may be kept over the latches when casting off the new yarn from sinkers to ensure that the new yarn is properly received in the latch needle hook. The latchguard member may be moved to the second position briefly before knocking over of the rib loop and until the newly formed loops have once more opened the latches. No mechanical opening of latches is required in the course of knitting a rib border. Wear at the tips of the latches which may lead to malfunctioning of the needles, is reduced. Provided the latchguard member movements are appropriately timed, the latchguard need not be accurately located. Simple latch needles adapted for transfer may be used for reducing cost.

Preferably the latchguard member is a plate having a substantially straight forward edge close to stems of bearded needles in the first position during feeding of a new yarn. Such a latchguard can be manufactured cheaply and its operation is not affected by sideways shogging of the needle bar for changing from $1\times1$ rib to $2\times2$ rib.

Conveniently the latchguarding member is mounted for in-out sliding movement only on the needle bar onto which it may be secured by catches to enable it to be removed from the rib needle bar. Advantageously the latchguard member is connected for joint movement with the rib needle bar and a drive mechanism associated with the latchguard member is arranged so as to superimpose the movement between the first and second position on the joint movement of the rib needle bar and the latchguard member.

Conveniently then the latchguard member is drivable by a first lever pivotably supported on a second lever for moving the rib needle bar and the latchguard member jointly, and the first lever is connected to a drive member connected through a lost motion arrangement permitting movement of the first lever by relative movement in one sense during joint movement but causing the drive member to pivot the first lever by relative movement in another sense. Thus concurrent movement of the needle bar and latchguard member can be facilitated.

The invention permits proper feeding of new yarn into open needle hooks and reduces mishaps resulting from premature latch closure without the latches being acted upon to open them in the course of knitting by anything other than the yarn in the needle hooks.

DESCRIPTION OF DRAWINGS

The invention is particularly described with reference to the drawings in which.

DESCRIPTION OF EXAMPLE OF INVENTION

Figure 1:
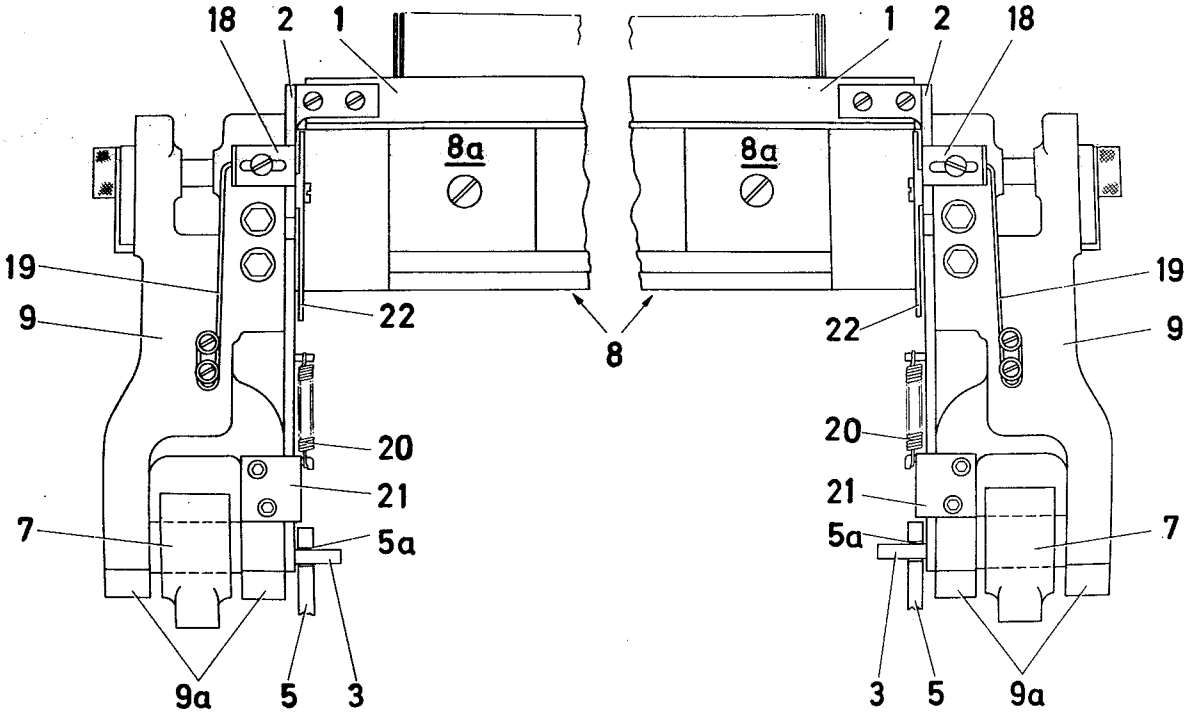
FIG. 1 shows a plan view of end part of a rib needle bar assembly according to the invention.
Figure 3A:
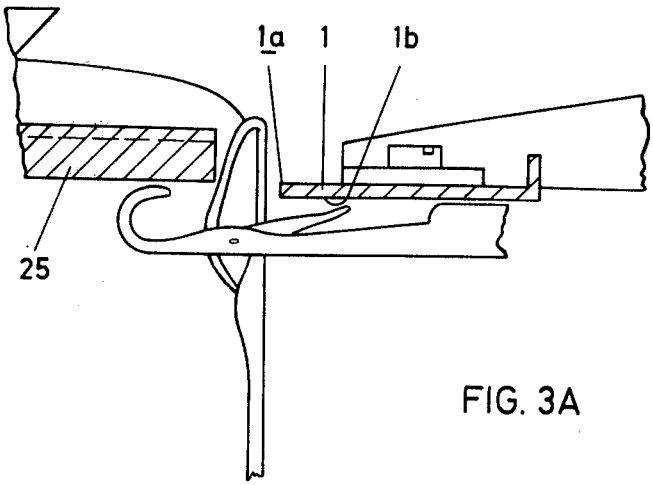
FIGS. 3A and 3B show the extremes of relative movement of the rib needle bar and latchguard member of the assembly of FIG. 1.

With reference to the drawings, individual knitting sections of a "rib to plain" straight bar knitting machine of the Cotton's Patent type are equipped with a rib needle bar assembly having a latchguard 1 which is common to all the rib needles (also called machine needles) in a particular section. This guard 1 has a substantially straight edge **1*a* and provides a single latchguarding surface 1*b* which is not interrupted. The guard 1 is equipped at each end with brackets 2 secured by screws. The brackets 2 extend at right angles to the guard 1 as shown in FIG. 1 and are equipped at their free ends with laterally extending stub spindles 3. The guard assembly of the guard 1 and the brackets 2 is located above latch needles of a rib needle bar 8. The brackets 2 rest on a cover 8*a* of rib needle bar 8**. The guard 1 is positioned relative to the needles by virtue of the stub spindles 3 which are located in slots 5a cut in the ends of a pair of bell crank levers 5 one at each end of the assembly. The bell crank levers 5 are mounted on spindles 6 (FIG. 1) which are screwed into the sides of the rib needle bar advance arms 7 for moving the rib needle bar 8 away from or towards a sinker bar 25 (see FIG. 3A and B). The pair of advance arms 7 are each located between trunnions 9a formed on rib needle bar link arms 9 fixed to the rib needle bar 8.

Figure 3B:
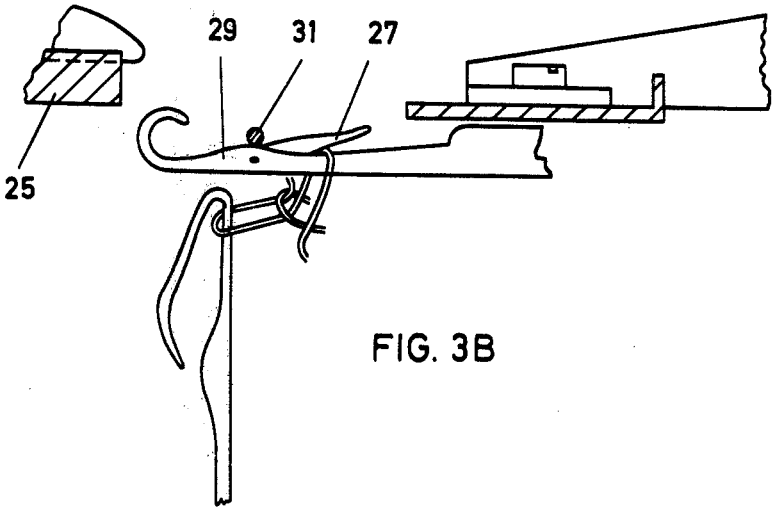
Figure 4:
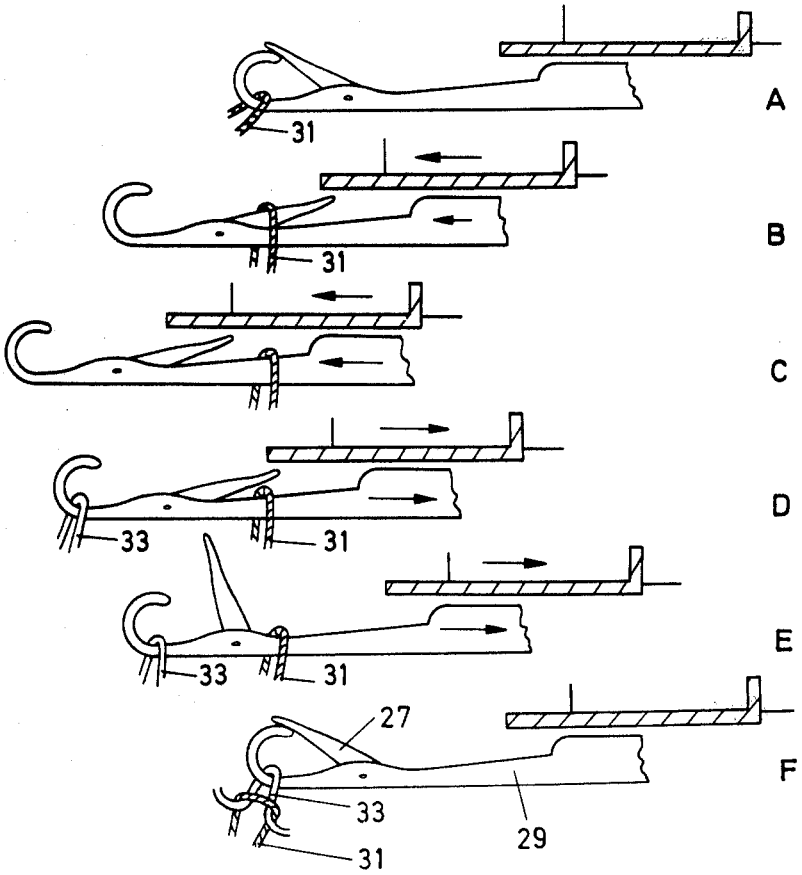
FIGS. 4A to F show successive stages of operation during knitting of rib loops.

During normal knitting, motions imparted to the rib needle bar 8 by the advance arms 7 through the link arms 9, will also be imparted to the latchguard 1 by the advance arms 7 through the bell crank levers 5. However the motion of the latchguard 1 can be varied to cause the guard to cover the open latches 27 of the rib needles 29 (see FIGS. 3 and 4) when required and at other times to be retracted to allow yarn to be fed into the hooks and to enable the latches 27 to close to permit knocking over of the old loops.

When the latchguard 1 is following the motion of the rib needle bar 8, control pins 5b in the bellcrank levers 5 can slide freely to and fro in arcuate slots 10a formed in pivoted control arms 10 without the latchguard movement being affected. In the position shown in FIGS. 2 and 3A, the latchguard 1 is in its retracted position which allows the needle latches to close when knocking over of the old yarn loops takes place.

In order to move the guard 1 to its advanced position (shown in FIG. 3B) the control arms 10 are oscillated about the spindles 6 to cause vertical movement of the control pins 5b thus causing a horizontal movement of the stub spindles 3 with respect to the rib needle bar in addition to any movement already imparted to the rib needle bar 8 and guard 1 jointly by the advance arm 7. The arms 10 are secured to a shaft 11 which is freely supported in the standard of a frame of the straight bar knitting machine. Pivotal motion is imparted to the shaft 11 by an arm 12 (see FIG. 2) secured to the shaft 11. The arm 12 receives its motion from a link 13, a truck arm 14, a roller 15 and a cam 16. The shaft 17 on which the cam 16 is mounted, is rotated constantly at the same speed as the shaft which drives a cam (not shown) which operates the arms 7 for advance of the rib needle bar 8 and guard 1 jointly. It therefore follows that a synchronised independent movement of the latchguard 1 to guard and unguard the needle latches takes place during each cycle of the rib needle bar motion.

For convenience in gaining access to the rib needles 29, provision is made for manually lifting the latchguard 1 away from the needle bar 8. This is accomplished by sliding catches 18 sideways against the action of associated spring 19. This action removes the catches clear of the latchguard brackets 2 and allows the guard 1 to be swung clear of the rib needle bar 8 as the brackets 2 pivot on their stub spindles. Springs 20 are anchored between the brackets 2 and anchor plates 21 secured to the rib needle bar link arms 9 so as to retain the stub spindles in the slots 5a of the bell crank levers 5 when the guard 1 is lifted. Props 22 can be swung about their pivot screws 23 to a vertical position and the latchguard 1 will then remain in the raised position without the need for continued lifting.

Figure 2:
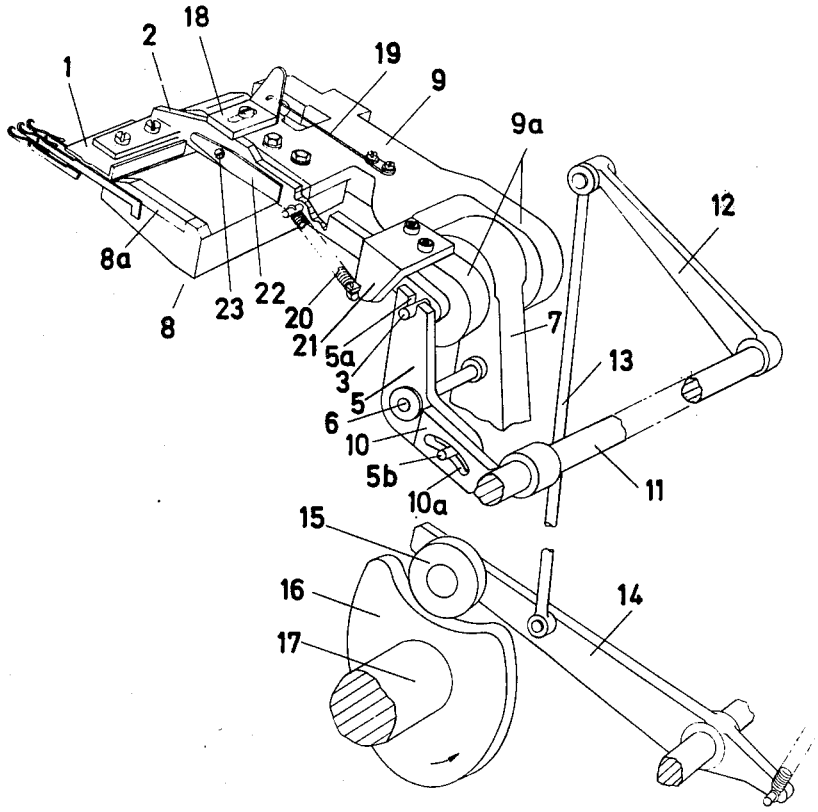
FIG. 2 shows a perspective view of one end part shown in FIG. 1.

With reference to FIGS. 4A to F, at one extreme of movement of the needles 29, the latches 27 have just been closed by a preceding knockover and the guard 1 is fully retracted (FIG. 4A). The needles 29 are then advanced jointly with the guard 1. The needle hooks are located under the sinker bar 25 and the old loops 31 open the latches 27 and start to clear the latches. Then (FIG. 4B) the guard 1 is advanced rapidly so that by the time the old loops 31 drop off the tips of the latches 27, the guard 1 is in the fully advanced position (FIG. 4C). The needle bar 8 is held in the fully advanced position for a predetermined period while a new yarn 33 is then fed into the hooks of the needles 29. During this period the arcuate slot 10a holds the latchguard 1 in the same relative position to the needle bar 8. The guard 1 and the needles 31 move back jointly with the guard 1 initially still in the advanced position. The old loops 31 rise up on the needle stems. Then the guard 1 is retracted (FIG. 4D) to the fully retracted position (FIG. 4E) whilst the needles 31 and the guard 1 are jointly being moved back. FIG. 2 shows a condition intermediate that of FIGS. 4D and 4E but without showing the yarn for clarity. Thus when the old loops 31 engage the latches 27 they can close, and knock over the old yarn 31 to give the position shown in FIG. 4F which is the same as FIG. 4A.

The needles 29 have loop spreaders (not shown) to enable plain bearded needles to take the loops when changing over from rib knitting to plain knitting. The bearded needles rise just in front of the edge of the guard 1 in the retracted position.

Just prior to a subsequent period of rib knitting, the latches 27 are initially opened by separate latch opening elements whilst the latchguard 1 is temporarily withdrawn. These opening elements are in the form of L-shaped hooks on a bar which first places the hook ends adjacent the closed needle hooks, moves endways to cause the ends to enter the needle hooks and then withdraws with respect to the needles to open the latches to enable the needles to take a set-up course for a rib border. The presser edge of the sinker bar 25 helps to ensure that the latches are kept open when the needle hook is advanced whilst still empty but does not perform any guarding function in the course of subsequent rib knitting.

The latchguard can only engage the latch tips when the latches are in the open attitude under the latchguard 1. The latchguard 1 need not be adapted to penetrate between sinkers.

I claim:

1. Rib needle bar assembly for a straight bar knitting machine including:

a rib needle bar; latch needles mounted on the rib needle bar having latches pivoted on stems, a latchguard member extending transversely across the stems and actuating means for moving the latchguard member relative to the needle bar between a first position extending across the needle latches in an open needle attitude to hold the latches open with sufficient clearance to allow old loops to clear the latches and a second position extending across the stems clear of the latches in the open needle attitude to permit closing of the latches by landing the old loops on the latches.

2. Rib needle bar assembly as claimed in claim 1 wherein the latchguard member has an uninterrupted latchguard surface for facing the latches which surface terminates in a substantially straight edge.

3. Rib needle bar assembly as claimed in claim 1 wherein means are provided on the needle bar for mounting the latchguard member slidably, the actuating means have a movable member mounted for bodily movement with the needle bar and for imparting relative motion to the latchguard member and drive means are provided for joint movement of the needle bar and latchguard member and for operating the said movable member to thereby superimpose sliding movement of the latchguard member onto the said joint movement.

4. Rib needle bar assembly as claimed in claim 3 in which the movable member is a lever arm pivotably connected to the latchguard member at one end and to the needle bar at the other end, a projection is provided on the lever arm and the actuating means further include an actuating lever, lost motion means interconnecting the projection and actuating lever to thereby permit the said joint movement in one actuating lever position and pivotable to shift the latchguard member with respect to the needle bar on moving from that actuating lever position.

* * * * *